US007749355B2

(12) United States Patent
Knobloch et al.

(10) Patent No.: US 7,749,355 B2
(45) Date of Patent: Jul. 6, 2010

(54) TISSUE PAPER

(75) Inventors: Thorsten Knobloch, Loveland, OH (US); Robert Stanley Ampulski, Fairfield, OH (US); Knut Petersen, Darmstadt (DE)

(73) Assignee: The Procter & Gamble Company, Cincinnati, OH (US)

( * ) Notice: Subject to any disclaimer, the term of this patent is extended or adjusted under 35 U.S.C. 154(b) by 267 days.

(21) Appl. No.: 11/257,733

(22) Filed: Oct. 25, 2005

(65) Prior Publication Data

US 2007/0062655 A1 Mar. 22, 2007

Related U.S. Application Data

(60) Provisional application No. 60/718,250, filed on Sep. 16, 2005.

(51) Int. Cl.
*D21H 27/30* (2006.01)
*B31F 1/12* (2006.01)
*B32B 29/00* (2006.01)

(52) U.S. Cl. ..... 162/123; 162/111; 162/124; 428/172; 428/153

(58) Field of Classification Search ..... 162/109, 162/111–113, 123–133; 156/60, 183; 428/156, 428/152–153, 537.5, 172
See application file for complete search history.

(56) References Cited

U.S. PATENT DOCUMENTS

| | | | |
|---|---|---|---|
| 2,624,245 | A | 1/1953 | Cluett |
| 3,011,545 | A | 12/1961 | Welsh et al. |
| 3,260,778 | A | 7/1966 | Walton et al. |
| 3,301,746 | A | 1/1967 | Sanford et al. |
| 3,329,556 | A | 7/1967 | McFalb et al. |
| 3,359,156 | A | 12/1967 | Freuler et al. |
| 3,414,459 | A | 12/1968 | Wells |
| 3,416,192 | A | 12/1968 | Packard |
| 3,426,405 | A | 2/1969 | Walton |
| 3,537,954 | A | 11/1970 | Justus |
| 3,554,863 | A | 1/1971 | Hervey et al. |
| 3,629,056 | A | 12/1971 | Forrest |
| 3,630,837 | A | 12/1971 | Freuler |
| 3,692,622 | A | 9/1972 | Dunning |
| 3,726,750 | A | 4/1973 | Stillings |
| 3,776,807 | A | 12/1973 | Dunning et al. |
| 3,806,406 | A | 4/1974 | Ely |
| 3,812,000 | A | 5/1974 | Salvucci, Jr. et al. |
| 3,821,068 | A | 6/1974 | Shaw |
| 3,846,228 | A | 11/1974 | Ely et al. |
| 3,905,863 | A | 9/1975 | Ayers |
| 3,926,716 | A | 12/1975 | Bates |
| 3,974,025 | A | 8/1976 | Ayers |
| 3,994,771 | A | 11/1976 | Morgan, Jr. et al. |
| 4,072,557 | A | 2/1978 | Schiel |
| 4,090,385 | A | 5/1978 | Packard |
| 4,100,017 | A | 7/1978 | Flautt, Jr. |
| 4,102,737 | A | 7/1978 | Morton |
| 4,120,747 | A | 10/1978 | Sarge, III et al. |
| 4,125,430 | A | 11/1978 | Grossman |
| 4,125,659 | A | 11/1978 | Klowak et al. |
| 4,127,637 | A | 11/1978 | Pietreniak et al. |
| 4,144,122 | A | 3/1979 | Emanuelson et al. |
| 4,157,938 | A | 6/1979 | Clemens et al. |
| 4,191,609 | A | 3/1980 | Trokhan |
| 4,191,756 | A | 3/1980 | Masi et al. |
| 4,196,045 | A | 4/1980 | Ogden |
| 4,300,981 | A | 11/1981 | Carstens |
| 4,309,246 | A | 1/1982 | Mulit et al. |
| 4,351,669 | A | 9/1982 | Nielsen |
| 4,440,597 | A | 4/1984 | Wells et al. |
| 4,448,638 | A | 5/1984 | Klowak |
| 4,464,224 | A | 8/1984 | Matolcsy |
| 4,469,735 | A | 9/1984 | Trokhan |
| 4,488,932 | A | 12/1984 | Eber et al. |
| 4,514,345 | A | 4/1985 | Johnson et al. |
| 4,528,239 | A | 7/1985 | Trokhan |
| 4,529,480 | A | 7/1985 | Trokhan |
| 4,551,199 | A | 11/1985 | Weldon |
| 4,556,450 | A | 12/1985 | Chuang et al. |
| 4,637,859 | A | 1/1987 | Trokhan |
| 4,808,266 | A | 2/1989 | Faurie |
| 4,849,054 | A | 7/1989 | Klowak |
| 4,940,513 | A | 7/1990 | Spendel |

(Continued)

FOREIGN PATENT DOCUMENTS

| | | | |
|---|---|---|---|
| EP | 0 342 646 | B1 | 11/1989 |

(Continued)

*Primary Examiner*—José A Fortuna
(74) *Attorney, Agent, or Firm*—C. Brant Cook; Peter D. Meyer

(57) ABSTRACT

The present invention provides for a tissue product comprising one or more tissue plies and having a total tensile value of less than about 1300 grams per inch, a $Bulk_{300}$ of greater than about 13.5 $cm^3/g$, and a caliper stability of greater than about 50%. The present invention also provides for a tissue product comprising at least three plies. The tissue product has a total tensile value of less than about 1300 grams per inch, a $Bulk_{300}$ greater than about 11 $cm^3/g$, and a caliper stability greater than 50%. The present invention further provides for a tissue product comprising as least two plies. The tissue product has a total tensile value of less than about 1300 grams per inch, a $Bulk_{300}$ of greater than about 7.0 $cm^3/g$, and a caliper stability of greater than about 83%.

16 Claims, No Drawings

U.S. PATENT DOCUMENTS

| | | | | | |
|---|---|---|---|---|---|
| 4,959,125 | A | | 9/1990 | Spendel | |
| 5,048,589 | A | | 9/1991 | Cook et al. | |
| 5,059,282 | A | | 10/1991 | Ampulski et al. | |
| 5,098,519 | A | | 3/1992 | Ramasubramanian et al. | |
| 5,098,522 | A | | 3/1992 | Smurkoski et al. | |
| 5,102,501 | A | | 4/1992 | Eber et al. | |
| 5,126,015 | A | | 6/1992 | Pounder | |
| 5,129,988 | A | | 7/1992 | Farrington, Jr. | |
| 5,245,025 | A | | 9/1993 | Trokhan et al. | |
| 5,275,700 | A | | 1/1994 | Trokhan | |
| 5,328,565 | A | | 7/1994 | Rasch et al. | |
| 5,334,289 | A | | 8/1994 | Trokhan et al. | |
| 5,348,620 | A | | 9/1994 | Hermans et al. | |
| 5,364,504 | A | | 11/1994 | Smurkoski et al. | |
| 5,399,412 | A | | 3/1995 | Sudall et al. | |
| 5,411,636 | A | | 5/1995 | Hermans et al. | |
| 5,429,686 | A | | 7/1995 | Chiu et al. | |
| 5,501,768 | A | | 3/1996 | Hermans et al. | |
| 5,527,428 | A | | 6/1996 | Trokhan et al. | |
| 5,556,509 | A | | 9/1996 | Trokhan et al. | |
| 5,575,891 | A | * | 11/1996 | Trokhan et al. | 162/111 |
| 5,591,309 | A | | 1/1997 | Rugowski et al. | |
| 5,593,545 | A | | 1/1997 | Rugowski et al. | |
| 5,601,871 | A | | 2/1997 | Krzysik et al. | |
| 5,607,551 | A | | 3/1997 | Farrington, Jr. et al. | |
| 5,616,207 | A | | 4/1997 | Sudall et al. | |
| 5,628,876 | A | | 5/1997 | Ayers et al. | |
| 5,629,052 | A | | 5/1997 | Trokhan et al. | |
| 5,637,194 | A | | 6/1997 | Ampulski et al. | |
| 5,656,132 | A | | 8/1997 | Farrington et al. | |
| 5,667,636 | A | | 9/1997 | Engel et al. | |
| 5,672,248 | A | | 9/1997 | Wendt et al. | |
| 5,746,887 | A | | 5/1998 | Wendt et al. | |
| 5,772,845 | A | | 6/1998 | Farrington, Jr. et al. | |
| 5,817,377 | A | * | 10/1998 | Trokhan et al. | 427/508 |
| 5,861,082 | A | * | 1/1999 | Ampulski et al. | 162/117 |
| 5,865,950 | A | | 2/1999 | Vinson et al. | |
| 5,885,421 | A | * | 3/1999 | Ensign et al. | 162/306 |
| 5,893,965 | A | * | 4/1999 | Trokhan et al. | 162/205 |
| 5,904,811 | A | * | 5/1999 | Ampulski et al. | 162/117 |
| 5,932,068 | A | | 8/1999 | Farrington, Jr. et al. | |
| 5,935,381 | A | * | 8/1999 | Trokhan et al. | 162/109 |
| 5,942,085 | A | | 8/1999 | Neal et al. | |
| 6,017,417 | A | | 1/2000 | Wendt et al. | |
| 6,048,938 | A | | 4/2000 | Neal et al. | |
| 6,146,499 | A | | 11/2000 | Lin et al. | |
| 6,171,442 | B1 | | 1/2001 | Farrington, Jr. et al. | |
| 6,355,139 | B1 | | 3/2002 | Baggot et al. | |
| 6,436,234 | B1 | | 8/2002 | Chen et al. | |
| 6,440,268 | B1 | | 8/2002 | Baggot et al. | |
| 7,156,954 | B2 | * | 1/2007 | Farrington et al. | 162/125 |
| 7,442,278 | B2 | * | 10/2008 | Murray et al. | 162/111 |
| 7,470,345 | B2 | * | 12/2008 | Troxell et al. | 162/118 |
| 7,485,373 | B2 | * | 2/2009 | Krzysik et al. | 428/532 |
| 7,497,923 | B2 | * | 3/2009 | Ward et al. | 162/123 |
| 7,497,925 | B2 | * | 3/2009 | Hermans et al. | 162/205 |
| 7,497,926 | B2 | * | 3/2009 | Hermans et al. | 162/205 |
| 7,524,403 | B2 | * | 4/2009 | Fernandes et al. | 162/358.4 |
| 2003/0089475 | A1 | * | 5/2003 | Farrington et al. | 162/109 |
| 2004/0206465 | A1 | * | 10/2004 | Farrington et al. | 162/123 |
| 2005/0022955 | A1 | * | 2/2005 | Ward et al. | 162/123 |
| 2006/0113049 | A1 | * | 6/2006 | Knobloch et al. | 162/117 |
| 2007/0062655 | A1 | * | 3/2007 | Knobloch et al. | 162/109 |
| 2007/0137810 | A1 | * | 6/2007 | Dyer et al. | 162/109 |
| 2007/0137811 | A1 | * | 6/2007 | Runge et al. | 162/109 |
| 2007/0240842 | A1 | * | 10/2007 | Scherb et al. | 162/205 |
| 2007/0251659 | A1 | * | 11/2007 | Fernandes et al. | 162/205 |

FOREIGN PATENT DOCUMENTS

| | | | | |
|---|---|---|---|---|
| EP | 0 617 164 | B1 | | 8/1997 |
| EP | 0 631 014 | B1 | | 10/1997 |
| EP | 0 806 520 | A1 | | 11/1997 |
| EP | 0 568 404 | B1 | | 12/1997 |
| GB | 1 212 473 | | | 11/1970 |
| GB | 1 533 045 | | | 11/1978 |
| GB | 2 001 370 | A | | 1/1979 |
| GB | 2 006 296 | A | | 5/1979 |
| GB | 2279372 | A | * | 1/1995 |
| GB | 2 303 647 | A | | 2/1997 |
| GB | 2 304 123 | A | | 3/1997 |
| JP | 05023262 | A | | 2/1993 |
| WO | WO 96/06223 | A1 | | 2/1996 |
| WO | WO 96/09435 | A1 | | 3/1996 |
| WO | WO 9932722 | A1 | | 7/1999 |
| WO | WO 00/47097 | | | 8/2000 |
| WO | WO 2006036194 | A1 | * | 4/2006 |
| WO | WO 2006047287 | A2 | * | 5/2006 |
| WO | WO 2007035503 | A1 | * | 3/2007 |

* cited by examiner

TISSUE PAPER

CROSS REFERENCE TO RELATED APPLICATIONS

This application claims the benefit of U.S. Provisional Application No. 60/718,250 filed on Sep. 16, 2005.

FIELD OF THE INVENTION

This invention relates to strong, soft, absorbent paper product having high bulk and high caliper stability and to processes for making such absorbent paper webs.

BACKGROUND OF THE INVENTION

One pervasive feature of daily life in modern, industrialized societies is the use of disposable products, particularly disposable products made of paper. Paper towels, facial tissues, sanitary tissues, and the like, are in almost constant use. Naturally, the manufacture of items in such great demand has become one of the largest industries in the industrially developed countries. The general demand for disposable paper products has, also naturally, created demand for improved versions of the products and of the methods for their manufacture. Despite great strides in papermaking, research and development efforts continue to be aimed at improving both the products and their processes for manufacture.

Disposable products such as paper towels, facial tissues, sanitary tissues, and the like, are made from one or more webs of tissue paper. If the products are to perform their intended tasks and to find wide acceptance, they, and the tissue paper webs from which they were made, must exhibit certain physical characteristics. Among the more important of these characteristics are strength, softness, and absorbency. Strength is the ability of a paper web to retain its physical integrity during use. Softness is a pleasing tactile sensation the user perceives as the paper is crumpled in their hand and is contacted to various portions of the anatomy. Absorbency is the characteristic of the paper web that facilitates the take up and retention of fluids, particularly water, aqueous solutions, and suspensions. Two important characteristics of a paper web include the absolute quantity of a fluid the given amount of paper will hold, but also the rate at which the paper web will absorb the fluid. When the paper web is formed into a device such as a towel or wipe, the ability of the paper web to cause a fluid to preferentially be taken up into the paper web and thereby leave a wiped surface dry is also important.

Traditionally, tissue products have been made using a wet-pressing process in which a significant amount of water is removed from a wet-laid web by pressing or squeezing water from the web prior to final drying. In particular, while supported by an absorbent papermaking felt, the web is squeezed between the felt and the surface of a rotating heated cylinder (Yankee Dryer) using a pressure roll as the web is transferred to the surface of the Yankee Dryer for final drying. The dried web is thereafter dislodged from the Yankee Dryer with a doctor blade (creping), which serves to partially de-bond the dried web by breaking many of the bonds previously formed during the wet-pressing stages of the process. Creping generally improves the softness of the web.

More recently, through-air drying has become a more prevalent means of drying tissue webs. Through-air drying provides a relatively non-compressive method of removing water from the web by passing hot air through the web until it is dry. More specifically, a wet-laid web is transferred from the forming fabric to a coarse, highly permeable through-air drying fabric and retained on the through-air drying fabric until it is dry. The resulting dry web is softer and bulkier than a wet-pressed un-creped dried sheet because fewer papermaking bonds are formed and because the web is less dense. Squeezing water from the wet web is eliminated, although subsequent transfer of the web to a Yankee Dryer for creping is still used to final dry and/or soften the resulting tissue.

Thus, it would be useful to provide for a tissue having properties particularly suitable for use as a bath tissue. The resulting tissues of the present invention are characterized by a unique combination of bulk and caliper stability as compared to currently available creped and uncreped paper towel and bath tissue products. Such attributes are needed to manufacture paper products that provide superior thickness and absorbency characteristics while maintaining low basis weight and yet still provide for the softness required such as for bath tissue, premium household towels, and facial tissue in the consumer market.

SUMMARY OF THE INVENTION

The present invention provides for a tissue product comprising one or more tissue plies and having a total tensile value of less than about 1300 grams per inch, a $Bulk_{300}$ of greater than about 13.5 $cm^3/g$, and a caliper stability of greater than about 50%.

The present invention also provides for a tissue product comprising at least three plies. The tissue product has a total tensile value of less than about 1300 grams per inch, a $Bulk_{300}$ greater than about 11 $cm^3/g$, and a caliper stability greater than 50%.

The present invention further provides for a tissue product comprising as least two plies. The tissue product has a total tensile value of less than about 1300 grams per inch, a $Bulk_{300}$ of greater than about 7.0 $cm^3/g$ and a caliper stability of greater than about 83%.

DETAILED DESCRIPTION OF THE INVENTION

The process of the present invention typically comprises at least six steps. Each step of the process is discussed in detail below.

The first step in the practice of the present invention is directed toward providing an aqueous dispersion of papermaking fibers. Papermaking fibers useful in the present invention include those cellulosic fibers commonly known as wood pulp fibers. Fibers derived from soft woods (gymnosperms or coniferous tress) and hard woods (angiosperms or deciduous trees) are contemplated for use in the present invention. The particular species of tree from which the fibers are derived is immaterial.

The wood pulp fibers can be produced from the native wood by any convenient pulping process. Chemical processes such as sulfite, sulphate (including the Kraft) and soda processes are suitable. Mechanical processes such as thermomechanical (or Asplundh) processes are also suitable. In addition, the various semi-chemical and chemimechanical processes can be used. Bleached as well as unbleached fibers are contemplated for use with the present invention. Preferably, when the paper web of this invention is intended for use in absorbent paper products such as paper towels, bleached northern softwood Kraft pulp fibers are preferred.

In addition to the various wood pulp fibers, other cellulosic fibers such as cotton linters, rayon, and bagasse can be used in the present invention. Synthetic fibers such as polyester and polyolefin fibers can also be used and in fact, are preferred in certain applications. Fibers also suitable for use with the present invention may include fibers, films and/or foams that comprise a hydroxyl polymer and optionally a crosslinking system. Nonlimiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose, cellulose derivatives such as cellulose ether and ester derivatives, gums, arabinans, galactans, proteins and various other polysaccharides, and mixtures thereof. For example, a web of the present invention may comprise a continuous and/or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer. Suitable fibers may also be coated or comprise latex, or latex-like, substances. Additional exemplary substrates are disclosed in U.S. Pat. Nos. 4,191,609; 4,300,981; 4,514,345; 4,528,239; 4,529,480; 4,637,859; 5,245,025; 5,275,700; 5,328,565; 5,334,289; 5,364,504; 5,411,636; 5,527,428; 5,556,509; 5,628,876; 5,629,052; and 5,637,194

Normally, the embryonic web (which is hereinafter defined) is prepared from an aqueous dispersion of the papermaking fibers. However, one of skill in the art will realize that fluids other than water can be used to disperse the fibers prior to their formation into an embryonic web.

Any equipment commonly used in the art for dispersing fibers can be used. The fibers are normally dispersed at a consistency of from about 0.1% to about 0.3% at the time an embryonic web is formed. As used herein, the moisture content of various dispersions, webs, and the like, is expressed in terms of percent consistency. Percent consistency is defined as 100 times the quotient obtained when the weight of dry fiber in the system under discussion is divided by the total weight of the system. An alternate method of expressing moisture content of a system sometimes used in the papermaking art is pounds of water per pound of fiber or alternatively and equivalently, kilograms of water per kilogram of fiber. The correlation between the two methods of expressing moisture content can be readily developed. For example, a web having a consistency of 25% comprises 3 kilograms of water per kilogram of fiber. A web having a consistency of 50% comprises 1 kilogram of water per kilogram of fiber. A web having a consistency of 75% comprises 0.33 kilograms of water per kilogram of fiber. Fiber weight is typically expressed on the basis of bone dry fibers.

In addition to papermaking fibers, the embryonic web is formed from a dispersion that may include various additives commonly used in the papermaking process. Examples of useful additives include wet strength agents such as urea-formaldehyde resins, melamine-formaldehyde resins, polyamide-epichlorohydrin resins, polyethyleneimine resins, polyacrylamide resins, and dialdehyde starches. Dry-strength additives, such as polysalt-coacervates rendered water-soluble by the inclusion of ionization suppressers, can also be used as would be known by one of skill in the art.

Other useful additives include debonders that increase the softness of the paper webs. Specific debonders that can be used in the present invention include quaternary ammonium chlorides. Exemplary debonders are described in U.S. Pat. Nos. 3,554,863; 4,144,122; and 4,351,669. Further, pigments, dies, fluorescers, and the like, commonly used in paper products can be incorporated into the dispersion. The second step of the present invention provides for the formation of an embryonic web of papermaking fibers on a first foraminous member from the aqueous dispersion provided in the first step. As used herein, an embryonic web is that web of fibers which is subjected to rearrangement on the deflection member hereinafter described. The embryonic web is typically formed from the aqueous dispersion of papermaking fibers by depositing that dispersion onto a foraminous surface and removing a portion of the aqueous dispersion medium. The fibers in the embryonic web normally have a relatively large quantity of water associated with them, typically ranging from about 5% to about 25%. As such, an embryonic web is typically too weak to be capable of existing without the support of an extraneous element such as a Fourdrinier wire. Regardless of the technique by which an embryonic web is formed, at the time of formation, such a web is subjected to rearrangement on the deflection member. Thus, the web must be held together by bonds weak enough to permit rearrangement of the fibers under the action of the forces required.

Any of the numerous techniques known to those of skill in the papermaking art can be used to provide for a suitable embryonic web. The precise method by which the embryonic web is formed is immaterial to the practice of the present invention so long as the embryonic web possesses the characteristics required. As a practical matter, continuous papermaking processes are preferred, even though batch processes, such as hand-sheet making processes, can be used. Processes that lend themselves to the practice of this step are described in U.S. Pat. Nos. 3,301,746; and 3,994,771.

As would be known to those of skill in the art, an aqueous dispersion of papermaking fibers is prepared and provided to a headbox that can be of any convenient design. From the headbox, an aqueous dispersion of papermaking fibers is delivered to a first foraminous member, typically a Fourdrinier wire. The dispersion delivered to the first foraminous member can be applied in a homogeneous or layered papermaking process.

The first foraminous member is typically supported by a breast roll and a plurality of return rolls. Optional auxiliary units and devices commonly associated with papermaking machines and with a first foraminous member may include forming boards, hydrofoils, vacuum boxes, tension rolls, support rolls, wire cleaning showers, and the like. In any regard, the purpose of a headbox and first foraminous member and any of the aforementioned auxiliary units and devices is to form an embryonic web of papermaking fibers.

After the aqueous dispersion of papermaking fibers is deposited onto a first foraminous member, the embryonic web is formed by removal of a portion of the aqueous dispersing medium by techniques well known to those of skill in the art. In this regard, vacuum boxes, forming boards, hydrofoils, and the like, may be useful in effecting water removal from the aqueous dispersion. Typically, an embryonic web travels with the first foraminous member about a return roll and is brought into the proximity of a second foraminous member.

The third step in the process of the present invention provides associating the embryonic web with a second foraminous member. This second foraminous member is sometimes referred to as a "deflection member." This third step provides the embryonic web into engaging contact with the deflection member on which the embryonic web will be deflected, rearranged, and further dewatered.

A deflection member suitable for use with the present invention takes the form of an endless belt. Typically, a deflection member passes around, and about, deflection member return rolls and impression nip rolls. Support rolls, return rolls, cleaning means, drive means, and the like, commonly used in papermaking processes and machines thereof, can also be associated with the deflection member. However, whatever physical form the deflection member takes (i.e., an endless belt, a stationary plate, or rotating drum and the like), it is preferred that the deflection member be foraminous. In other words, the deflection member must possess continuous passages connecting a first surface (also known in the art as the "upper surface" or "working surface" or the "embryonic web-contacting surface") with its second surface (also known as the "lower surface"). Stated in another way, the deflection member must be constructed in such a manner that when water is caused to be removed from the embryonic web, such as by the application of differential fluid pressure, that when the water is removed from the embryonic web in the direction of the foraminous member, the water can be discharged from the system without having to again contact the embryonic web in either the liquid or the vapor state.

Secondly, the embryonic web-contacting surface of the deflection member must comprise a macroscopically mono-planer, patterned, continuous network surface. This network surface must define within the deflection member, a plurality of discrete, isolated, deflection conduits. When a portion of the embryonic web-contacting surface of the deflection member is placed into a planer configuration, the network surface is essentially mono-planer. It is said to be "essentially" mono-planer to recognize the fact that deviations from absolute planarity are tolerable, but not preferred, so long as the deviations are not substantial enough to adversely affect the performance of the product formed on the deflection member. The network surface is said to be "continuous" because the lines formed by the network surface must form at least one essentially unbroken net-like pattern. The pattern is said to "essentially" continuous to recognize the fact that interruptions in the pattern are tolerable, but not preferred, so long as the interruptions are not substantial enough to adversely affect the performance of the product made on the deflection member. It should be understood that a network surface can be provided with a variety of patterns having various shapes, sizes, and orientations, as well as the deflection conduits provided within a deflection member. In a preferred embodiment, a deflection member is foraminous in that deflection conduits provided therein extend through the entire thickness of a deflection member and provide the necessary continuous passages connecting its two surfaces.

As will be known to one of skill in the art, the deflection conduits provided can be discrete. In other words, the deflection conduits can have a finite shape that depends on the pattern selected for the network surface and are separated one from another. However, an infinite variety of geometries for the network surface and the openings of the deflection conduits are possible. However, it should be recognized that since the network surface defines the deflection conduits, the specification of the relative directions, orientations, and widths of each element or branch of the network surface will, of necessity, define the geometry and distribution of the openings of the deflection conduits. Conversely, specification of the geometry and distribution of the openings of the deflection conduits will define the relative directions, orientations, widths, and the like, of each branch of the network surface. Further, while the openings of the deflection conduit can be a random shape and in random distribution, they are preferably of a uniform shape and are distributed in a repeating, pre-selected pattern. Practical shapes include circles, ovals, and polygons of six or fewer sides. However, there is no requirement that the openings of the deflection conduits be regular polygons or that the sides of the openings be straight. Openings with curved sides, such as trilobal figures may be used.

A preferred form of the deflection member is an endless belt which can be constructed by a method adapted from techniques used to make stencil screens. By adapted, it is meant that the broad, overall techniques of making stencil screens are used, however, improvements, refinements, and modifications, may be used to make the member having significantly greater thickness than the usual stencil screen.

Broadly, a foraminous element is thoroughly coated with a liquid photosensitive polymeric resin to a pre-selected thickness. A mask, or negative, incorporating the pattern of the pre-selected network surface is juxtaposed the liquid photosensitive resin. The resin is then exposed to light of an appropriate wavelength through the mask. This exposure to light causes the resin to cure in the exposed areas. Unexposed, and uncured, resin is thereafter removed from the system leaving behind the cured resin forming the network surface defining within it, a plurality of discrete, isolated deflection conduits. Additionally, the deflection member can be prepared using as the foraminous woven element, a belt of width and length suitable for use on the chosen papermaking machine. The network surface and the deflection conduits are formed on this woven belt in a series of sections of convenient dimensions in a batch-wise manner. The preparation of an exemplary deflection member is discussed in detail in U.S. Pat. No. 4,529,480.

The fourth step of the present invention requires deflecting the fibers in the embryonic web into the deflection conduits and removing water from the embryonic web such as by the application of differential fluid pressure to the embryonic web thereby forming an intermediate web of papermaking fibers. Such deflection is to be effected under such conditions that there is essentially no water removal from the embryonic web through the deflection conduits after the embryonic web has been associated with the deflection member prior to the deflecting of the fibers into the deflection conduits. Such deflection can be induced by the application of differential fluid pressure to the embryonic web. One preferred method of applying differential fluid pressure is by exposing the embryonic web to a vacuum in such a way that the web is exposed to the vacuum through a deflection conduit by application of a vacuum to the deflection member on the side designated to be a bottom surface. Such vacuum can be provided by the use of a vacuum box. Optionally, positive pressure in the form of air or steam pressure can be applied to an embryonic web in the vicinity of the vacuum box through the first foraminous member. In this step, an embryonic web has then been transformed into an intermediate web.

The fifth step in the process of the present invention is the drying of the intermediate web to form a paper web of the present invention. As should be known to those of skill in the art, any convenient means can be used to dry the intermediate web. For example, flow-through dryers and Yankee Dryers, alone and in combination, are satisfactory.

Preferably, the quantity of water removed in a pre-dryer is controlled so that a pre-dried web exiting such a pre-dryer has a consistency of from about 30% to about 98%. The pre-dried web, which is still associated with the deflection member, passes around the deflection member return roll and may travel to an impression nip roll. As the pre-dried web is preferably passed through a nip formed between an impression nip roll and a Yankee Dryer drum, the network pattern formed by the deflection member is impressed into the pre-dried web to form an imprinted web. This imprinted web is preferably adhered to the surface of a Yankee Dryer drum, where it is dried to a consistency of at least about 95%.

A sixth optional, but highly preferred step, provides for foreshortening of the dried web. Foreshortening refers to the reduction in length of a dry paper web that occurs when energy is applied to the dry web in such a way that the length of the web is reduced and the fibers in the web are rearranged with an accompanying disruption of fiber-fiber bonds. Foreshortening can be accomplished in any of several well-known ways. The most common and most preferred method of foreshortening is creping. In such a creping operation, the dried web is adhered to the surface and then removed from that surface with a doctor blade. Usually, the surface to which the web is adhered also functions as a drying surface and can be the surface of a Yankee Dryer or any other drying surface present in the drying operation.

As mentioned, supra, the pre-dried web typically passes through the nip formed between an impression nip and the Yankee Dryer drum. At this point, the network pattern formed by the deflection member is impressed into the pre-dried web to form the imprinted web. This imprinted web is adhered to the surface of the Yankee Dryer drum. Such adherence is facilitated by the use of a creping adhesive. Typical creping adhesives include those based on polyvinyl alcohol. Examples of adhesives suitable for use with the present invention are described in U.S. Pat. No. 3,926,716. The adhesive is applied to either the pre-dried web immediately prior to its passage through the nip or the surface of the Yankee Dryer drum prior to the point at which the web is pressed against the surface thereto. The paper web adhered to the surface of the Yankee is dried to at least about 95% consistency and is removed (i.e., creped) from that surface by the doctor blade. Energy is thus supplied to the web and the web is foreshortened. The exact pattern of the network surface and its orientation relative to the doctor blade, will in major part, dictate the extent and the character of the creping imparted to the web.

The paper web, can then be calendared and rewound, or cut and stacked, as required. This paper web is then ready for use.

As will be known to those of skill in the art, in addition to creping, other techniques for foreshortening paper webs are known. For example, one technique for mechanically foreshortening a fibrous web involves subjecting the web to compaction between a hard surface and a relatively elastic surface. This technique is described in U.S. Pat. Nos. 2,624,245; 3,011,545; 3,329,556; 3,359,156; and 3,630,837. Additionally, the web of the present invention may be foreshortened by techniques known in the trade as microcreping. Such methods for microcreping are described in U.S. Pat. Nos. 3,260,778; 3,416,192; 3,426,405; and 4,090,385. Additional, exemplary creping and/or wet-micro contraction processes are disclosed in U.S. Pat. Nos. 4,191,756; 4,440,597; 5,865,950; 5,942,085; and 6,048,938.

While the foregoing describes a preferred method for producing a paper web, other methods of producing paper webs suitable for use with the present invention are known to those of skill in the art. Such other methods of producing paper webs suitable for use with the present invention are described in U.S. Pat. No. 5,607,551.

An exemplary process for embossing paper webs in accordance with the present invention provides for a tissue ply structure being embossed in a gap between two embossing rolls. The embossing rolls may be made from any material known for making such rolls, including, without limitation, steel, rubber, elastomeric materials, and combinations thereof. As known to those of skill in the art, each embossing roll may be provided with a combination of emboss knobs and gaps. Each emboss knob comprises a knob base and a knob face. The surface pattern of the rolls, that is the design of the various knobs and gaps, may be any design desired for such a product.

As would be known to one of skill in the art, the plurality of embossments of the embossed tissue paper product of the present invention could be configured in a non-random pattern of positive embossments and a corresponding non-random pattern of negative embossments. Further, such positive and negative embossments may be embodied in random patterns as well as combinations of random and non-random patterns. By convention, positive embossments are embossments that protrude toward the viewer when the embossed product is viewed from above the surface of the web. Conversely, negative embossments are embossments that appear to push away from the viewer when the embossed product is viewed from above a surface.

Preferred paper webs of the present invention have a total tensile value of less than about 1300 grams per inch (511.8 g/cm) and a basis weight of preferably greater than about 14 $g/m^2$ per ply, more preferably greater than about 18 $g/m^2$ per ply, and most preferably greater than about 22 $g/m^2$ per ply. Additionally, preferred paper webs of the present invention can be produced comprising at least 1 ply and have a $Bulk_{300}$ of greater than about 13.5 $cm^3/g$, more preferably greater than about 14.0 $cm^3/g$, and most preferably greater than about 14.5 $cm^3/g$. Further, such paper webs of the present invention have a caliper stability of greater than about 50%, more preferably greater than about 60%, even more preferably greater than about 70%, and most preferably greater than about 75%. Preferred paper webs of the present invention can also be produced having at least 3 plies. Such at least 3-ply paper webs preferably have a $Bulk_{300}$ of at least about 11 $cm^3/g$, more preferably at least about 12.0 $cm^3/g$, and even more preferably at least about 13.5 $cm^3/g$. Such webs will also have a caliper stability of at least about 50%, more preferably at least about 60%, even more preferably at least about 70%, and most preferably at least about 75%. Additionally, two-ply products of the present invention can be produced that have a $Bulk_{300}$ preferably greater than about 7 $cm^3/g$ and a caliper stability preferably at least about 83%, more preferably at least about 84%, and most preferably at least about 85%.

Those skilled in the art are familiar with the effect of creping on paper webs. In a simplistic view, creping provides the web with a plurality of microscopic or semi-microscopic corrugations that are formed as the web is foreshortened, the fiber-fiber bonds are broken, and the fibers are rearranged. In general, the microscopic or semi-microscopic corrugations extend transversely across the web. That is to say, the lines of microscopic corrugations are perpendicular to the direction in which the web is traveling at the time it is creped. They are also parallel to the line of the doctor blade that produces the creping. The crepe imparted to the web is more or less permanent so long as the web is not subjected to tensile forces that can normally remove crepe from a web. In general, creping provides the paper web with extensibility in the machine direction.

During a normal creping operation, the network portions of the paper web are adhesively adhered to the creping surface (e.g., Yankee Dryer drum). As the web is removed from the creping surface by the doctor blade, creping is imparted to the web in those areas that are adhered to the creping surface. Thus, the network region of the web of this invention is directly subjected to creping.

Since the network region and the domes are physically associated in the web, a direct affect on the network region must have, and does have, an indirect affect on the domes. In general, the effects produced by creping on the network region (the higher density regions) and the domes (the lower density regions) of the web are different. It is presently believed that one of the most notable differences is an exaggeration of strength properties between the network region and the domes. That is to say, since creping destroys fiber-fiber bonds, the tensile strength of a creped web is reduced. It appears that the web of the present invention, while the tensile strength of the network region is reduced by creping, the tensile strength of the domes is concurrently reduced to a relatively greater extent. Thus, the difference in tensile strength between the network region and the domes appears to be exaggerated by creping. Differences in other properties can also be exaggerated depending on the particular fibers used in the web and the network region and dome geometries.

The creping frequency (i.e., the number of corrugations per unit length in the machine direction of the web) is dependent on a number of factors including the thickness of the network region, the absolute strength of the network region, the nature of the adhesive association between the network region and the creping surface, and the pre-selected pattern of the network region. It has been observed that the creping frequency is higher in the network region than in the domes. However, as noted above, foreshortening or creping is known to enhance the extensibility of the creped web in the machine direction. When the pre-selected network pattern is one of the preferred patterns mentioned above, creping enhances extensibility not only in the machine direction but also the cross-machine direction and in other intermediate directions, all dependent on, among other things, the pre-selected pattern of the network region. To also note, it has been observed that foreshortening enhances the flexibility of the web.

The paper web of the present invention can be used in any application where soft, absorbent tissue paper webs are required. One particular advantageous use of the paper web of the present invention is in paper towel and tissue products. For example, two, or more, paper webs of the present invention can be adhesively secured or otherwise bonded together in a face-to-face relation as taught in U.S. Pat. No. 3,414,459. Therefore, this process can be used to form two-ply or any other number of ply (i.e., 3-ply, 4-ply, x-ply, etc.) paper products as required.

Example

By way of illustration, a fiber furnish comprising about 35% bleached northern softwood Kraft fiber, and about 65% hardwood Kraft fiber is prepared. The fiber is pulped for 10 minutes at about 4-5 percent consistency and diluted to about 2.5% to 3.0% percent consistency after pulping. A Parez wet strength additive (commercially available from Bayer in Pittsburgh, Pa.) is added to the bleached northern softwood Kraft fiber thick stock at a rate of about 2.5 lbs/ton pulp (1.25 g/t) and to the hardwood Kraft fiber thick stock at a rate of about 1.0 lbs/ton (0.50 g/t) of pulp. The headbox net slice opening is about 0.650 inches (1.65 cm). The consistency of the stock fed to the headbox is about 0.20 percent consistency. The resulting wet fibrous structure is formed with a fixed-roof former and breast roll and formed on an 84×78 M forming wire (commercially available from Albany International, Appleton, Wis.). The speed of the forming wire is about 12.5 feet per second (381 cm/sec). The embryonic fibrous structure is then dewatered to a consistency of about 18-19% using vacuum suction before being transferred to a through-drying belt, which is traveling at about 12.5 feet per second (381 cm/sec). The fibrous structure is then transferred to a deflection member comprising deflection conduits by the suction of a pick-up shoe at a vacuum of about 12-13 in Hg (0.40-0.43 atm). The design is imparted to the fibrous structure as it is deflected into the deflection conduits. The fibrous structure is then carried over a multi-stage suction box with a vacuum of about 12-13 in Hg (0.40-0.43 atm), resulting in an intermediate fibrous structure consistency of about 27%. The intermediate fibrous structure is carried over a through-dryer operating at a temperature of about 335° F. to 350° F. (168° C.-176° C.) and dried to a consistency of about 58.5% to produce a pre-dried fibrous structure. The predried fibrous structure is then transferred through an impression nip roll to a Yankee dryer traveling at a speed of about 12.5 feet per second (381 cm/sec) to form an imprinted fibrous structure. The imprinted fibrous structure is then creped from the Yankee dryer surface with a final dryness of at least about 93% consistency to produce a creped fibrous structure. The resulting creped fibrous structure is then tested for physical properties with conditioning as described infra. The creped fibrous structure may, or may not be embossed during the converting process. The resulting creped fibrous structures produced in accordance with the present invention exhibit the measured and calculated properties detailed in Table 1 infra.

Test Methods

Conditioning

Samples produced according to the present invention are conditioned in accordance with TAPPI conditions T402-OM88 for a minimum of 2 hours at 23±1° C. and 50±2% RH. Testing is carried out under the same temperature and humidity conditions.

Basis Weight Method

"Basis Weight" as used herein is the weight per unit area of a sample reported in lbs/3000 $ft^2$ or $g/m^2$. Basis weight is measured by preparing one or more samples of a known area ($m^2$). These sample(s) produced in accordance with the present invention, as well as other paper product(s) comprising fibrous structures, are weighed on a top loading balance having a minimum resolution of 0.01 g. The balance is protected from air drafts and other disturbances using a draft shield. Sample weights are recorded when the readings on the balance become constant. The average weight (in g) is calculated and the average area of the samples ($m^2$) is recorded/reported. The basis weight ($g/m^2$) is calculated by dividing the average weight (g) by the average area of the samples ($m^2$).

Caliper Stability

Caliper versus load data are obtained using a Thwing-Albert Model EJA Materials Tester, equipped with a 2000 g load cell and compression fixture. The compression fixture consisted of the following; load cell adaptor plate, 2000 gram overload protected load cell, load cell adaptor/foot mount 1.128 inch (2.865 cm) diameter presser foot, #89-14 anvil, 89-157 leveling plate, anvil mount, and a grip pin, all available from Thwing-Albert Instrument Company, Philadelphia, Pa. The compression foot is one square inch (6.45 $cm^2$) in area. The instrument is run under the control of Thwing-Albert Motion Analysis Presentation Software (MAP V1,1, 6,9). A single sheet of a conditioned sample is cut to a diameter of approximately 2 inches (5.08 cm). The sample must be less than 2.5-inch (6.35 cm) diameter (the diameter of the anvil) to prevent interference of the fixture with the sample. Care should be taken to avoid damage to the center portion of the sample, which will be under test. Scissors or other cutting tools may be used.

For the test, the sample is centered on the compression table under the compression foot. The compression and relaxation data are obtained using a crosshead speed of 0.1 inches/minute (0.25 cm/minute). The deflection of the load cell is obtained by running the test without a sample being present. This is generally known as the Steel-to-Steel data. The Steel-to-Steel data are obtained at a crosshead speed of 0.005 in/min (1.27 mm/min). Crosshead position and load cell data are recorded between the load cell range of 5 grams and 1500 grams for both the compression and relaxation portions of the test. Since the foot area is one square inch (6.45 $cm^2$), this corresponded to a range of 5 grams/$in^2$ (76.5 Pa) to 1500 grams/$in^2$ (22.7 kPa). The maximum pressure exerted on the sample is 1500 g/$in^2$ (22.7 kPa). At 1500 g/$in^2$ (22.7 kPa) the crosshead reverses its travel direction. Crosshead position values are collected at 6 selected load values during the test. These correspond to pressure values of 100, 300, 500, 500, 300, 100 g/$in^2$ (1.52, 4.56, 7.60, 7.60, 4.56, 1.52 kPa) for the compression and relaxation direction. During the compression portion of the test, crosshead position values are collected by the MAP software, by defining three traps (Trap 1 to Trap 3) at load settings of 100, 300, 500 g/$in^2$ (1.52, 4.56, 7.60 kPa). During the return portion of the test, crosshead position values are collected by the MAP software, by defining three return traps (Return Trap 1 to Return Trap 3) at load settings of 500, 300, 100 g/$in^2$ (7.60, 4.56, 1.52 kPa). The seventh trap is the trap at max load (1500 g/$in^2$) (22.7 kPa). Again values are obtained for both the Steel-to-Steel and the sample. Steel-to-Steel values are obtained for each batch of testing. If multiple days are involved in the testing, the values are checked daily. The Steel-to-Steel values and the sample values are an average of four replicates.

Caliper values are obtained by subtracting the average Steel-to-Steel crosshead trap values from the sample crosshead trap value at each trap point. The values from the four individual replicates on each sample are averaged and reported. For simplicity, the Initial Compression Ratio is reported as $Caliper_{100}$, $Caliper_{300}$, and $Caliper_{500}$ (in mm) respectively.

The caliper stability is expressed as the percentage decline in the overall compressibility of the material. Mathematically, this is expressed as:

$$CaliperStability = [\%] = \left(1 - \frac{Caliper_{100} - Caliper_{500}}{Caliper_{100}}\right) \times 100$$

where:

$Caliper_x$=measured caliper with a Xg load placed upon the presser foot.

Bulk

The bulk (measured in $cm^3$/g) is calculated as the measure of the caliper at 300 g loading (based upon the Caliper Stability test described supra) divided by the basis weight of the material. Mathematically, this relationship is expressed as:

$$Bulk[cm^3/g] = \frac{Caliper_{300}[mm]}{BasisWeight[g/m^2]} \times 1000$$

where:

$Caliper_{300}$=measured caliper with a 300 g load placed upon the presser foot; and, Basis Weight=basis weight of the sample being tested.

Tensile Strength—Us Toilet Tissue Except Lotioned Toilet Tissue

For new toilet tissue rolls, discard the first 15 usable units from the sample roll. Remove five strips of four (4) usable units from the sample roll. Carefully lay the five (5) strips, one on top of the other to form a long stack, keeping the perforations between the strips coincident. Identify usable units number 1 and 3 for machine direction tensile measurement and usable units number 2 and 4 for cross direction tensile measurement. Cut through the long stack at the line of perforations making 4 small stacks. Cut two tensile strips 1 inch (2.54 cm) wide from each small stack, one at a time, in the direction indicated above. This makes four tensile strips for machine direction testing and four tensile strips for cross direction testing. Each tensile strip is 5 usable units thick. A usable unit for a one-ply tissue is one ply. A usable unit of a two-ply product is two plies. A usable unit for more than two plies is the number of plies in the sample.

Tensile Strength—US Lotioned Toilet Tissue & European 2-/3-/4-Ply Toilet Tissue

For new sample roll discard 15 usable units from the sample roll. Remove one strip of four (4) usable units from the sample roll. Identify usable unit number 1 and 3 for machine direction tensile and usable unit number 2 and 4 for cross direction. Cut through the perforations. Cut two tensile strips 1 inch (2.54 cm) wide for each usable unit in the direction indicated above. This makes four tensile strips for machine direction testing and four tensile strips for cross direction testing. Each tensile strip is one usable unit thick.

Tensile Strength—Roll Towels

For a new roll remove and discard at least the first eight towels. Remove four (4) usable units or towels and form into a stack making sure all the towels are aligned the same in regard to machine direction. Cut tensile strips from the stack in both the machine direction and cross direction. This makes four tensile strips for machine direction testing and four tensile strips for cross direction testing. Each tensile strip is one usable unit thick.

Tensile Strength—Operation

For all tissue, either bar or flat face clamps may be used for testing. Peak tensile and peak elongation are measured using a Thwing-Albert (Philadelphia, Pa.) EJA 1000 or EJA 2000 tensile tester equipped with MAP Software. The gauge length for toilet tissue is 2 inches (5.08 cm) and the gauge length for towel is four inches (10.16 cm). All tests are performed at 4 inches-per-minute (10.16 cm/min) cross head speed. The sampling rate is 20 points/second. The peak tensile is reported in g/2.54 cm per usable unit. Elongation is reported as percent elongation at peak tensile. Four machine direction samples are tested and averaged to obtain a value for the machine direction tensile strength. Four cross-machine direction samples are tested and averaged to obtain a value for the cross-machine direction tensile strength. Total tensile strength is the sum of the machine direction tensile strength and the cross-machine direction tensile strength.

Table 1 gives details of the resulting tissue properties for examples 1 through 13 illustrating the present invention. Additionally, Table 1 details the resulting tissue properties of 25 known tissue products. As used in Table 1, the column headings have the following meanings:

Sample refers to the unique sample identifier. Known tissue products are identified alphabetically (A-Y). Illustrations of the products produced by the present invention are represented numerically (1-13). Ply count is the number of plies present in the sample tested. Embossed refers to whether or not the sample tested was subjected to an embossing process. Basis weight is the basis weight of the sample being tested in accordance with the method described supra, expressed in g/$m^2$. Total tensile is the total tensile strength of the product being tested in accordance with the method described supra, expressed in g/25.4 mm (g/$in^2$). The caliper at 100 g ($Caliper_{100}$), 300 g ($Caliper_{300}$), and 500 g ($Caliper_{500}$) is the measured caliper (in mm) as conducted by the initial compressibility ratio test described supra, with a 100 g, 300 g, or 500 g load placed upon the presser foot respectively. All values of caliper are expressed in units of thickness (in mm) measured at a load of (100 g, 300 g, or 500 g) per unit area ($in^2$). The $Bulk_{300}$ is reported as the calculated result of the equation described supra using the $Caliper_{300}$ value, expresses in $cm^3/g$. The caliper stability is reported as the calculated value of the equation described supra, expressed in units of percent.

TABLE 1

Tabulated Data for Various Known and Inventive Tissue Properties

| Product ID | Ply Count # | Embossed yes/no | Basis Weight gsm | Total Tensile g/25.4 mm | $Caliper_{100}$ mm | $Caliper_{300}$ mm | $Caliper_{500}$ mm | $Bulk_{300}$ $cm^3/g$ | Caliper Stability % |
|---|---|---|---|---|---|---|---|---|---|
| A | 2 | no | 44.1 | 767 | 0.66 | 0.57 | 0.53 | 12.96 | 79.8 |
| B | 2 | no | 52.2 | 961 | 0.68 | 0.57 | 0.52 | 10.97 | 76.1 |
| C | 2 | no | 54.5 | 944 | 0.63 | 0.54 | 0.49 | 9.85 | 77.8 |
| D | 2 | no | 42.1 | 882 | 0.51 | 0.44 | 0.41 | 10.52 | 81.0 |
| E | 1 | no | 31.4 | 400* | 0.37 | 0.30 | 0.28 | 9.59 | 74.5 |
| F | 1 | no | 31.4 | 400* | 0.36 | 0.30 | 0.28 | 9.58 | 78.2 |
| G | 1 | no | 31.2 | 400* | 0.30 | 0.26 | 0.24 | 8.25 | 79.2 |
| H | 1 | no | 34.2 | 400* | 0.50 | 0.43 | 0.39 | 12.59 | 79.2 |
| I | 2 | no | 52.1 | 500* | 0.55 | 0.46 | 0.42 | 8.86 | 77.5 |
| J | 2 | no | 48.4 | 500* | 0.56 | 0.45 | 0.41 | 9.36 | 71.9 |
| K | 2 | no | 46.9 | 500* | 0.45 | 0.38 | 0.35 | 8.05 | 77.9 |
| L | 2 | no | 51.6 | 500* | 0.78 | 0.64 | 0.57 | 12.42 | 73.4 |
| M | 1 | no | 31.6 | 479 | 0.49 | 0.37 | 0.32 | 11.81 | 64.8 |
| N | 2 | yes | 42.6 | 532 | 0.43 | 0.27 | 0.25 | 6.44 | 57.2 |
| O | 2 | yes | 38.8 | 461 | 0.43 | 0.37 | 0.35 | 9.62 | 80.3 |
| P | 2 | no | 47.1 | 772 | 0.36 | 0.32 | 0.30 | 6.79 | 82.4 |
| Q | 1 | yes | 40.3 | 760 | 0.44 | 0.33 | 0.29 | 8.09 | 64.7 |
| R | 2 | no | 35.3 | 783 | 0.42 | 0.36 | 0.34 | 10.29 | 80.2 |
| S | 2 | yes | 45.7 | 610 | 0.36 | 0.30 | 0.28 | 6.59 | 75.9 |
| T | 2 | no | 49.2 | 1001 | 0.34 | 0.31 | 0.29 | 6.21 | 85.5 |
| U | 3 | yes | 50.9 | 1121 | 0.68 | 0.53 | 0.42 | 10.50 | 60.9 |
| V | 3 | yes | 56.3 | 1040 | 0.55 | 0.45 | 0.41 | 8.04 | 74.3 |
| W | 3 | yes | 52.7 | 1183 | 0.65 | 0.51 | 0.46 | 9.75 | 70.0 |
| X | 3 | yes | 50.3 | 963 | 0.43 | 0.32 | 0.28 | 6.27 | 64.8 |
| Y | 4 | yes | 64.1 | 1424 | 0.50 | 0.42 | 0.39 | 6.63 | 77.2 |
| 1 | 2 | yes | 36.8 | 579 | 0.67 | 0.57 | 0.52 | 15.61 | 77.9 |
| 1a | 2 | yes | 36.8 | 563 | 0.64 | 0.57 | 0.53 | 15.41 | 82.0 |
| 1b | 2 | yes | 37.1 | 613 | 0.62 | 0.55 | 0.51 | 14.91 | 81.7 |
| 2 | 2 | no | 44.8 | 878 | 0.80 | 0.68 | 0.62 | 15.23 | 77.7 |
| 3 | 2 | no | 44.8 | 878 | 0.84 | 0.71 | 0.64 | 15.88 | 75.9 |
| 4 | 2 | no | 44.7 | 940 | 0.75 | 0.65 | 0.60 | 14.64 | 80.3 |
| 5 | 2 | no | 44.7 | 940 | 0.78 | 0.67 | 0.61 | 14.90 | 77.8 |
| 6 | 2 | no | 51.9 | 894 | 0.97 | 0.85 | 0.79 | 16.40 | 81.1 |
| 7 | 2 | no | 51.9 | 894 | 1.01 | 0.87 | 0.80 | 16.79 | 79.0 |
| 8 | 2 | no | 44.3 | 865 | 0.87 | 0.73 | 0.64 | 16.39 | 73.9 |
| 9 | 2 | no | 43.9 | 743 | 0.90 | 0.76 | 0.67 | 17.30 | 74.6 |
| 10 | 2 | no | 51.4 | 906 | 0.90 | 0.77 | 0.68 | 14.91 | 75.9 |
| 11 | 2 | no | 51.4 | 852 | 0.89 | 0.78 | 0.70 | 15.09 | 79.0 |
| 12 | 2 | no | 50.3 | 916 | 0.80 | 0.69 | 0.63 | 13.72 | 78.0 |
| 13 | 2 | no | 50.5 | 846 | 0.83 | 0.73 | 0.66 | 14.35 | 79.5 |

*denotes a target average value

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-ply tissue product comprising two or more tissue plies and having a basis weight of greater than 36.8 $g/m^2$, a total tensile value of less than about 1300 grams per inch, a $Bulk_{300}$ of 15.23 $cm^3/g$ or greater, a $Caliper_{100}$ of 0.62 mm or greater, and a caliper stability of greater than about 50%.

2. The tissue product according to claim 1 wherein said tissue product has a basis weight of greater than about 14.0 $g/m^2$ per ply.

3. The tissue product according to claim 1 wherein said tissue product has a caliper stability greater than about 60%.

4. The tissue product according to claim 3 wherein said tissue product has a caliper stability greater than about 70%.

5. The tissue product according to claim 1 wherein said tissue product has two plies.

6. The tissue product according to claim 1 wherein said tissue product is through-air dried.

7. The tissue product according to claim 6 wherein said tissue product is foreshortened.

8. The tissue product according to claim 7 wherein said tissue product is foreshortened by creping.

9. A tissue product comprising at least three plies, said tissue product having a basis weight of greater than about 36.8 $g/m^2$, a total tensile value of less than about 1300 grams per inch, a $Bulk_{300}$ of 15.23 $cm^3/g$ or greater, a $Caliper_{100}$ of 0.62 mm or greater, and a caliper stability greater than 50%.

10. The tissue product according to claim 9 wherein said tissue product has a basis weight greater than 14.0 $g/m^2$ per ply.

11. The tissue product according to claim 9 wherein said tissue product has a caliper stability greater than about 60%.

12. The tissue product according to claim 9 wherein said tissue product is foreshortened.

13. The tissue product according to claim 9 wherein said tissue product is through-air dried.

14. A tissue product comprising as least two plies, said tissue product having a basis weight of greater than about 36.8 $g/m^2$, a total tensile value of less than about 1300 grams per inch, a $Bulk_{300}$ of 15.23 $cm^3/g$ or greater, a $Caliper_{100}$ of 0.62 mm or greater, and a caliper stability of greater than about 83%.

15. The tissue product according to claim 14 wherein said tissue product is uncreped.

16. The tissue product according to claim 14 wherein said at least two plies are bonded together.

* * * * *

UNITED STATES PATENT AND TRADEMARK OFFICE

CERTIFICATE OF CORRECTION

PATENT NO. : 7,749,355 B2
APPLICATION NO. : 11/257733
DATED : July 6, 2010
INVENTOR(S) : Thorsten Knobloch et al.

It is certified that error appears in the above-identified patent and that said Letters Patent is hereby corrected as shown below:

In Col. 11, line 38, the words *"CaliperStabilit y*= [%] =" should be *CaliperStability* [%] =

Signed and Sealed this
Twenty-eighth Day of December, 2010

David J. Kappos

David J. Kappos
*Director of the United States Patent and Trademark Office*